US008044904B2

(12) United States Patent
Endo et al.

(10) Patent No.: US 8,044,904 B2
(45) Date of Patent: Oct. 25, 2011

(54) DISPLAY DEVICE

(75) Inventors: Kenta Endo, Mobara (JP); Yoshihisa Ooishi, Yokohama (JP)

(73) Assignee: Hitachi Displays, Ltd., Chiba (JP)

( * ) Notice: Subject to any disclaimer, the term of this patent is extended or adjusted under 35 U.S.C. 154(b) by 877 days.

(21) Appl. No.: 12/028,046

(22) Filed: Feb. 8, 2008

(65) Prior Publication Data

US 2009/0201317 A1 Aug. 13, 2009

(51) Int. Cl.
*G09G 3/36* (2006.01)

(52) U.S. Cl. ..... 345/89; 345/690

(58) Field of Classification Search ..... 345/89, 345/690

See application file for complete search history.

(56) References Cited

U.S. PATENT DOCUMENTS 5,796,379 A * 8/1998 Enomoto et al. ..... 345/89
2004/0001054 A1 1/2004 Nitta et al.
2004/0101058 A1 5/2004 Sasai et al.
2005/0162360 A1* 7/2005 Ishihara et al. ..... 345/89
2007/0115233 A1* 5/2007 Endo et al. ..... 345/89

FOREIGN PATENT DOCUMENTS

JP 2003-280599 10/2003
JP 2005-006275 1/2005

* cited by examiner

*Primary Examiner* — Quan-Zhen Wang
*Assistant Examiner* — Troy Dalrymple
(74) *Attorney, Agent, or Firm* — Antonelli, Terry, Stout & Kraus, LLP.

(57) ABSTRACT

The present invention reduces moving image blurring while suppressing the lowering of brightness, lowering of contrast and the increase of electricity necessary for light emission. A display device includes a first gradation voltage generation circuit which generates a first gradation voltage based on gradations of display data amounting to 1 screen displayed during 1 frame period, and a second gradation voltage generation circuit which generates a second gradation voltage based on the gradations of display data amounting of 1 screen displayed in 1 frame period, wherein the gradations of the respective pixels on the display data are displayed by performing a display based on the first gradation voltage and a display based on the second gradation voltage during 1 frame period.

2 Claims, 8 Drawing Sheets

DISPLAY DEVICE

BACKGROUND OF THE INVENTION

1. Field of the Invention

The present invention relates to a hold-response-type display device such as a liquid crystal display or an organic EL (electro-luminescence) display.

2. Description of the Related Art

Conventionally, in classifying a display device such as a display for a television receiver set or a personal computer (PC) from a viewpoint of moving image display, the display device is roughly classified into an impulse-response-type display device and a hold-response-type display device. The impulse-response-type display device is a display device of a type in which a brightness response is lowered immediately after scanning as in the case of afterglow characteristic of a cathode ray tube, for example. Further, the hold-response-type display device is of a type in which the brightness based on display data is continuously held until next scanning as in the case of a liquid crystal display, for example.

The above-mentioned hold-response-type display device can obtain favorable display quality with no flickers when a still image is displayed, for example. However, in displaying a moving image, there arises so-called moving image blurring in which a periphery of a moving object is blurred thus giving rise to a drawback that display quality is remarkably lowered. The occurrence of the moving image blurring is attributed to so-called retina image retention in which when a viewer moves his/her sight line along with the movement of the displayed object, the viewer interpolates display images before and after the movement with respect to the displayed image with fixed brightness. Accordingly, in the hold-response-type display device, even when a response speed is enhanced as fast as possible, it is impossible to completely eliminate the moving image blurring. Accordingly, with respect to the hold-response-type display device, for example, there has been proposed a method which approximates a visual effect to a viewer to a corresponding visual effect of the impulse-response-type display device by canceling the retina image retention with updating of a display image at a shorter cycle or with the insertion of a black screen thus reducing a moving image blurring.

A typical example of the display device which is required to perform a moving image display is a television receiver set, wherein scanning frequency of the television receiver set is standardized to 60 Hz in a NTSC method and 50 Hz in a PAL method, for example. Accordingly, when frame frequency of a display image which is formed based on these scanning frequencies is set to 60 Hz or 50 Hz, the frequency is not so high that moving image blurring occurs.

As a technique which updates the display image at a shorter cycle as described above for overcoming the moving image blurring in the television receiver set, there has been proposed a technique which elevates scanning frequency and increases an updating speed of an image by generating display data of an interpolation frame based on display data between frames (hereinafter, abbreviated as an interpolation frame generation method) (for example, see patent document 1).

Further, as a technique which inserts the above-mentioned black screen (black frame), for example, there has been proposed a technique which inserts black display data between display data (hereinafter, abbreviated as black display data insertion method) (for example, see patent document 2).

Patent Document 1: JP-A-2005-6275 (corresponding US patent application: US2004/0101058A1)

Patent Document 2: JP-A-2003-280599 (corresponding US patent application: US2004/0001054A1)

Although the moving image blurring can be overcome by applying the above-mentioned techniques to the hold-response-type display, there has been known that the following drawbacks arise due to the application of such techniques.

In the above-mentioned interpolation frame generation method, the display data of the interpolation frame which originally does not exist is generated. Accordingly, to generate more accurate display data, a circuit scale is increased. On the other hand, when the circuit scale is suppressed, generation errors occur in the display data of the interpolation frame thus giving rise to a possibility that display quality is remarkably deteriorated.

On the other hand, in the method which inserts the black frame, in principle, there arise no generation errors of display data of the interpolation frame. Further, also in view of the circuit scale, the black frame insertion method is advantageous compared to the interpolation frame generation method. However, with respect to the technique which is referred to as the black display data insertion method or a blink backlight method, either method lowers the display brightness in all gradations by an amount corresponding to the black frame. When the brightness of a backlight is increased in the black display data insertion method for compensating for the lowered amount of brightness, for example, the power consumption is increased correspondingly and, at the same time, considerable time and efforts become necessary to cope with the generation of heat. Further, due to the increase of an absolute value of leaking of light in a black display, contrast is lowered. On the other hand, in the blink backlight method, a large current becomes necessary for bringing a light turn-off state to a light turn-on state or a response speed of a visible light differs from each other for every wave lengths due to the difference in fluorescent material thus generating a coloring phenomenon.

SUMMARY OF THE INVENTION

Accordingly, it is an object of the present invention to provide a display device which can reduce a moving image blurring while suppressing lowering of brightness, lowering of contrast and the increase of electric power necessary for light emission.

The above-mentioned and other object and novel features of the present invention will become apparent from the description of this specification and attached drawings.

The following is an explanation of the summary of typical inventions among the inventions disclosed in this specification.

(1) The present invention is directed to a display device includes: a display panel having a plurality of pixels; a first driver generating gradation voltages corresponding to gradation of the respective pixels based on display data inputted from an external system and outputting the gradation voltages to the respective pixels of the display panel, the first driver including a first gradation voltage generation circuit which generates first gradation voltages and a second gradation voltage generation circuits which generates second gradation voltages based on gradations of display data for 1 screen displayed during 1 frame period; a second driver for selecting pixels to be supplied with the gradation voltages, the second driver scanning the respective pixels twice within the 1 frame period, the display device being configured such that the respective pixels of the display panel perform displays of gradations based on the first gradation voltages and displays of gradations based on the second gradation voltages during the 1 frame period to display the gradations of the respective pixels in the display data inputted from the external system, wherein the first gradation voltage generation circuit and the second gradation voltage generation circuit respectively include a resistance voltage dividing circuit which is constituted by connecting a plurality of resistances in series, the resistance voltage dividing circuit of the first gradation voltage generation circuit sets a plurality of resistance values which change magnitudes of the plurality of gradation voltages at intermediate gradations to an approximately fixed value, and the resistance voltage dividing circuit of the second gradation voltage generation circuit, in gradation regions where the plurality of resistance values of the resistance voltage dividing circuit of the first gradation voltage generation circuit is set to an approximately fixed value, changes the resistance values from resistance values lower than the resistance values of the resistance voltage dividing circuit of the first gradation voltage generation circuit to resistance values higher than the resistance values of the resistance voltage dividing circuit of the first gradation voltage generation circuit.

(2) In the display device having the constitution (1), the first gradation voltage generation circuit and the second gradation voltage generation circuit respectively include a resistance voltage dividing circuit which generates gradation voltages of positive polarity and a resistance voltage dividing circuit which generates gradation voltages of negative polarity.

According to the display device of the present invention, in the hold-response-type display device, it is possible to reduce moving image blurring while suppressing lowering of brightness, lowering of contrast and the increase of electric power necessary for light emission.

Further, in the hold-response-type display device, it is possible to perform a smooth gradation display while reducing moving image blurring.

DESCRIPTION OF THE PREFERRED EMBODIMENT

Hereinafter, the present invention is explained in detail in conjunction with an embodiment by reference to drawings.

Here, in all drawings for explaining the embodiment, parts having identical functions are given same symbols and their repeated explanation is omitted.

Further, in the explanation made hereinafter, a period during which display data amounting to 1 screen inputted to a display device from an external system is displayed is defined as 1 frame period, and a period during which all scanning signal lines of the display device (display panel) are selected once is defined as 1 field. Accordingly, in a conventional general display device, 1 frame period and 1 field period are equal to each other.

Further, brightness which is acquired by repeating scanning in a state that display data is fixed is defined as static brightness, average brightness during 1 field period is defined as dynamic brightness, and brightness which a viewer recognizes with his/her naked eyes is defined as naked-eye brightness. Accordingly, in the conventional general hold-response-type display device, when display data is not changed, the static brightness, the dynamic brightness and the naked-eye brightness are substantially equal to each other.

Figure 1:
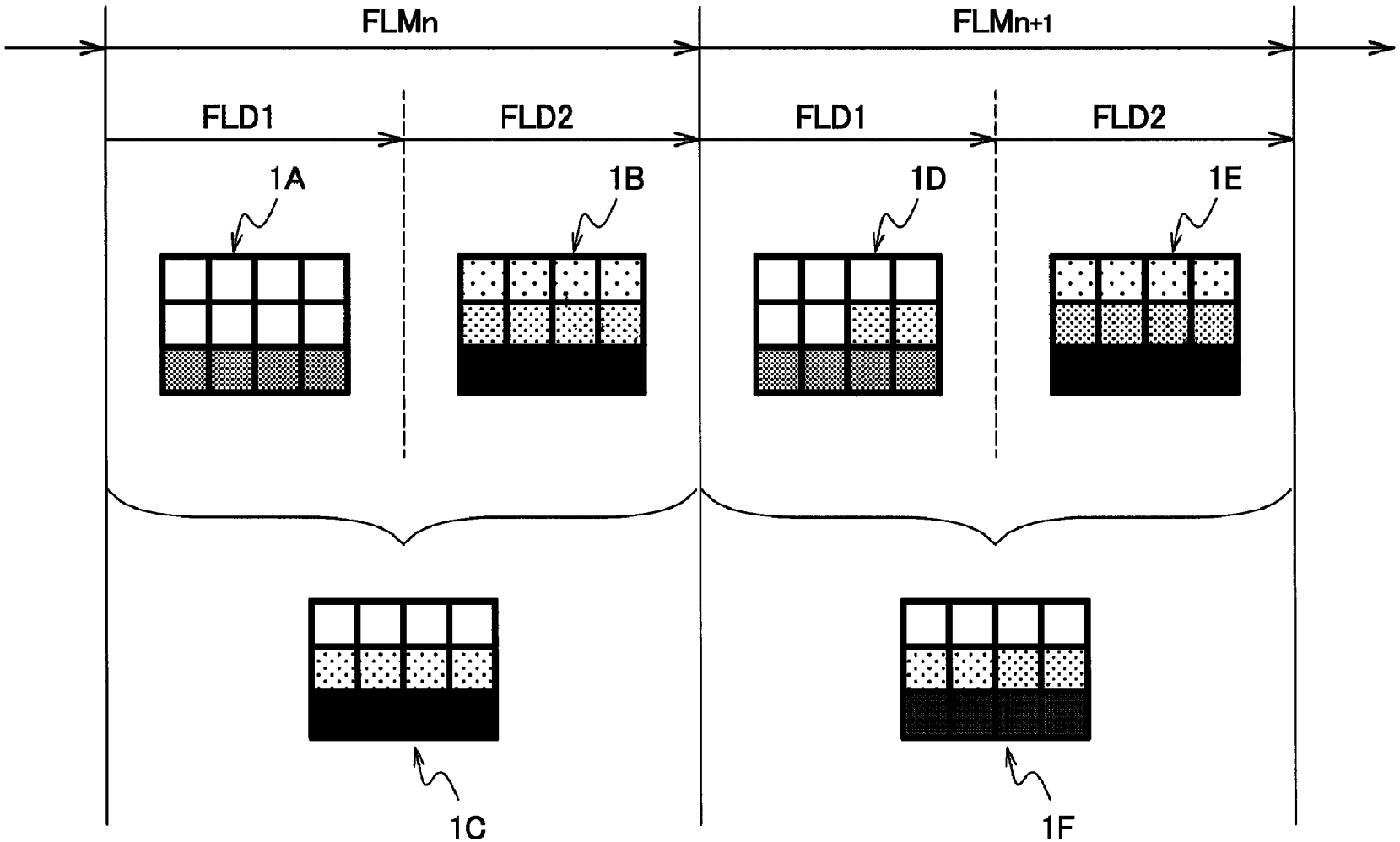
FIG. 1 is a schematic view for explaining a principle of a display method according to a display device of the present invention.
Figure 2:
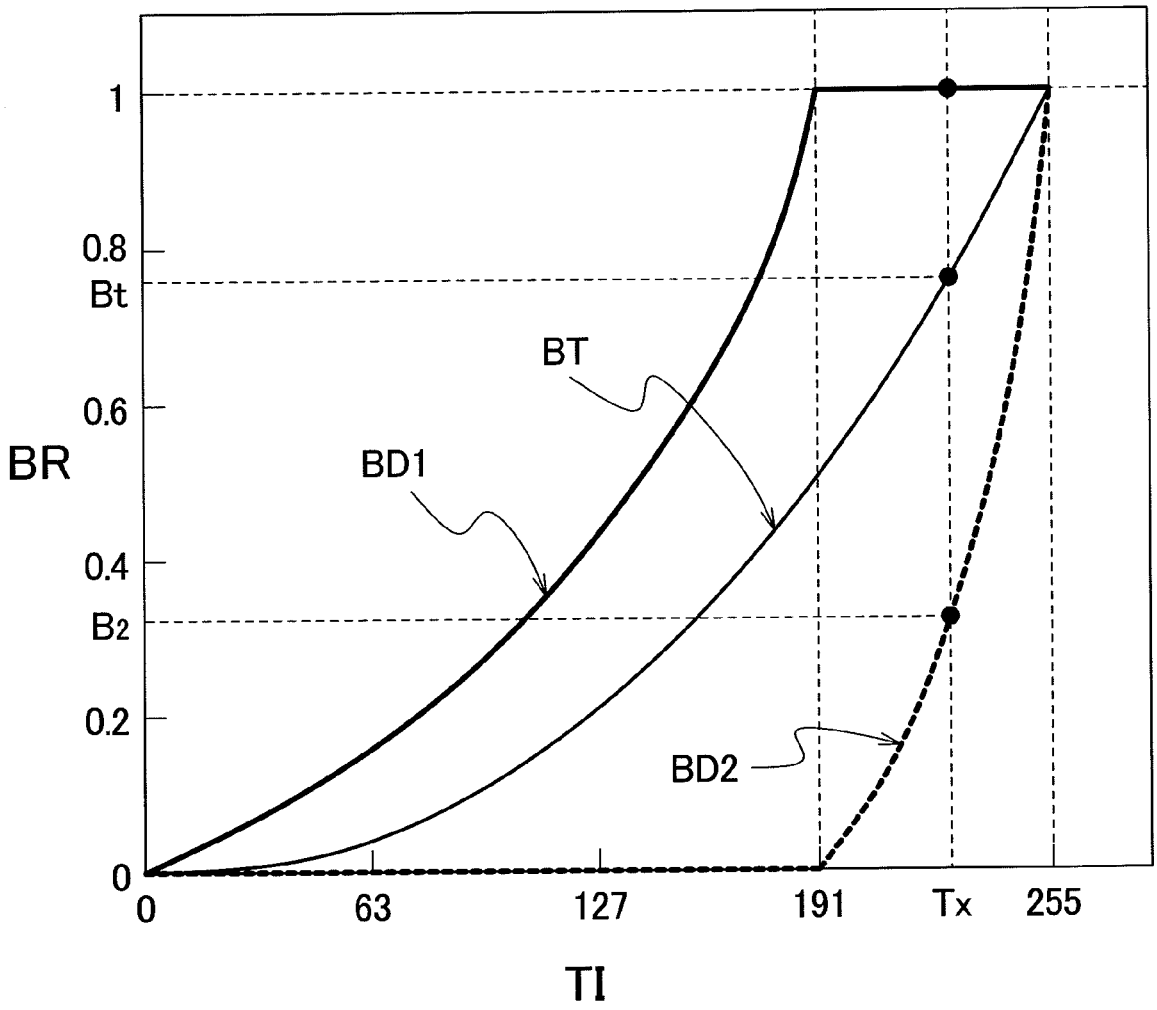
FIG. 2 is a schematic graph showing one example of the relationship among a first field period, a second field period and naked-eye brightness in the display method shown in FIG. 1.

FIG. 1 is a schematic view for explaining a principle of a display method according to the display device of the present invention. FIG. 2 is a schematic graph showing one example of the relationship among a first field period, a second field period and the naked-eye brightness in the display method shown in FIG. 1.

In the display device of the present invention, the conversion of display data is performed such that a plurality of field periods is allocated to 1 frame period and, at the same time, the naked-eye brightness acquired form the dynamic brightnesses of the plurality of fields is made to substantially agree with the static brightness based on the display data inputted from an external system. Here, the naked-eye brightness substantially agrees with an average value of the dynamic brightnesses during the respective field periods of the plurality of field periods.

Further, when two field periods are allocated to 1 frame period, respective pixels of the display panel are scanned twice during 1 frame period. For example, as shown in FIG. 1, during a certain 1 frame period $FLM_n$, display data 1A is displayed during the first field period FLD1 and display data 1B is displayed during the second field period FLD2.

Here, what the viewer recognizes with his/her naked eyes is display data 1C which is formed by synthesizing the display data 1A during the first field period FLD1 and the display data 1B during the second field period FLD2. Accordingly, by setting the dynamic brightnesses of the respective field periods such that an average value of the dynamic brightnesses of the respective pixels of the display data 1A displayed during the first field period FLD1 and the dynamic brightnesses of the respective pixels of the display data 1B displayed during the second field period FLD2 agrees with the still brightness acquired based on the display data inputted from the external system, the naked-eye brightnesses of the respective pixels of the display data 1C which the viewer recognizes with his/her naked eyes substantially agree with the still brightness.

In the same manner, during the next frame period $FLM_{n+1}$, display data 1D is displayed during the first field period FLD1 and display data 1E is displayed during the second field period FLD2.

Here, what the viewer recognizes with his/her naked eyes is display data 1F which is formed by synthesizing the display data 1D during the first field period FLD1 and the display data 1E during the second field period FLD2. Accordingly, by setting the dynamic brightnesses of the respective field periods such that an average value of the dynamic brightnesses of the respective pixels of the display data 1D displayed during the first field period FLD1 and the dynamic brightnesses of the respective pixels of the display data 1E displayed during the second field period FLD2 agrees with the still brightness, the naked-eye brightnesses of the respective pixels of the display data 1F which the viewer recognizes with his/her naked eyes substantially agree with the display brightness inputted from the external system.

Here, the respective display data 1A to 1F shown in FIG. 1 schematically express the brightnesses of display data of the respective pixels in the display panel which is constituted of 12 pixels in total in which 4 pixels are arranged in the lateral direction and 3 pixels are arranged in the vertical direction.

In the display device which adopts such a display method, the dynamic brightness of the display data 1A displayed during the first field period FLD1 of the frame period $FLM_n$ and the dynamic brightness of the display data 1B displayed during the second field period FLD2 of the frame period $FLM_n$ may be determined as follows. For example, in comparing the dynamic brightness during the first field period FLD1 and the dynamic brightness during the second field period FLD2, the dynamic brightness during the first field period FLD1 is set higher than or equal to the dynamic brightness during the second field period FLD2 in all gradations. A brightness curve BD1 which expresses the relationship between the gradation during the first field period FLD1 and the relative brightness, and a brightness curve BD2 which expresses the relationship between the gradation during the second field period FLD2 and the relative brightness which are set from the above-mentioned viewpoint are depicted as shown in FIG. 2, for example. In FIG. 2, the gradation TI of the display data is taken on an axis of abscissas, and the relative brightness BR is taken on an axis of ordinates. Further, FIG. 2 shows a case in which 256 gradations from 0th gradation to 225th gradation can be displayed, wherein the brightnesses of the respective gradations when the brightness at 0th gradation is set to 0 and the brightness at 255th gradation is set to 1 are shown.

In the conventional display device in which 1 frame period and 1 field period agree with each other, for example, the relationship between the gradation TI of the inputted display data and the relative brightness BR is set to the relationship expressed by the brightness curve BT (fine solid line). Assuming the gradation of the display data inputted from the external system as $T_x$, the display data displayed during the 1 frame period is converted such that the relative brightness (static brightness) assumes $B_t$.

On the other hand, in the display device which constitutes 1 frame period using two field periods, for example, assuming the gradation of the display data inputted from the external system as $T_x$, as shown in FIG. 2, the display data displayed during the first field period FLD1 is converted such that the relative brightness (dynamic brightness) becomes 1 based on the brightness curve BD1 (bold solid line), and the display data displayed during the second field period FLD2 is converted such that the relative brightness (dynamic brightness) becomes $B_2$ based on the brightness curve BD2 (bold dotted line). Due to such constitution, the naked-eye brightness substantially agrees with an average value of the relative brightness 1 and the relative brightness $B_2$ and hence, the average value of the relative brightness value $B_2$ becomes substantially equal to the static brightness $B_t$.

Further, in comparing the brightness curve BD1 during the first field period FLD1 and the brightness curve BD2 during the second field period FLD2, as shown in FIG. 2, when the relative brightness during the first field period FLD1 is higher than or equal to the relative brightness during the second field period FLD2 at all brightness TI, the first field period FLD1 is referred to as a bright field, and the second field period FLD2 is referred to as a dark field.

Here, assuming that the static brightness takes a value ranging from 0 to 1, for example, when the dynamic brightness during the first field period FLD1 (bright field) is set to 0.5 and the dynamic brightness during the second field period FLD2 (dark field) is set to 0, the naked-eye brightness of approximately 0.25 can be acquired by changing over these fields. In the same manner, when the dynamic brightness during the first field period FLD1 is set to 1 and the dynamic brightness during the second field period FLD2 is set to 0, by changing over these fields, the naked-eye brightness of approximately 0.5 is acquired. In this manner, provided that the dynamic brightness during the second field period FLD2 is 0, the present invention can obtain the similar advantageous effects as the black frame insertion method thus enhancing the prevention of the moving image blurring.

Further, as a technique which is similar to the present invention, a multi gradation method which is referred to as a so-called FRC (Frame Rate Control) method has been generally known. The FRC method is a method which realizes multiple gradation exceeding gradation which a data driver possesses by repeating gradation displays which differ for respective frames. To the contrary, the present invention provides the technique for overcoming moving image blurring and the device which realizes such a technique. For realizing such a device, 1 frame period is divided into the first field period FLD1 and the second field period FLD2 and, at the same time, the device is driven with frequency twice as large as frame frequency inputted from the external system. The present invention differs from the FRC system due to such constitution.

Here, FIG. 2 shows one example of the brightness curve BD1 during the first field period FLD1 and the brightness curve BD2 during the second field period FLD2. By allowing the display device of the present invention to acquire the below-mentioned brightness distribution, the present invention can overcome the moving image blurring and, at the same time, can realize the smooth gradation expression.

Figure 3A:
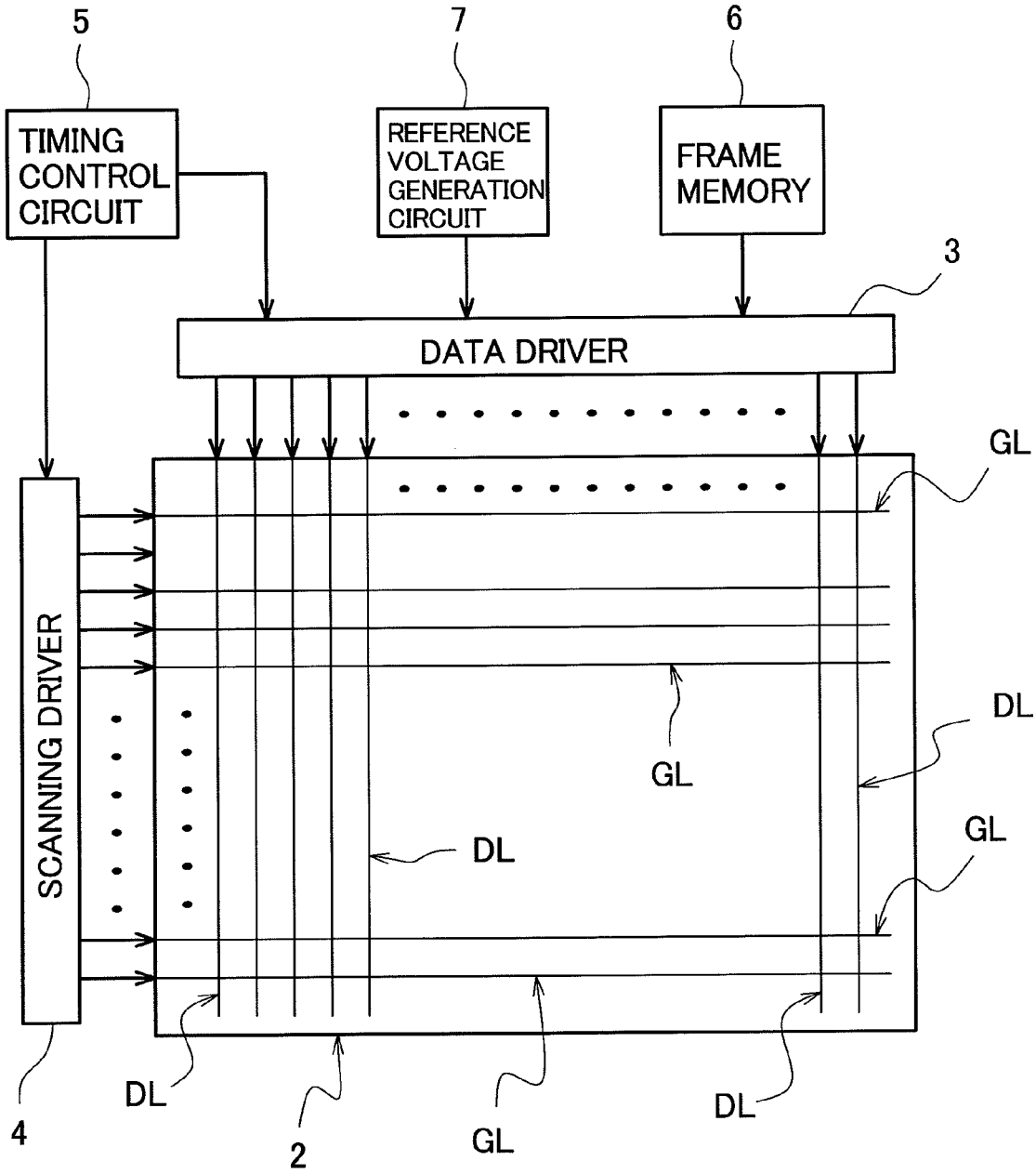
FIG. 3A is a schematic block diagram showing one example of the schematic constitution of the display device according to the present invention.
Figure 3B:
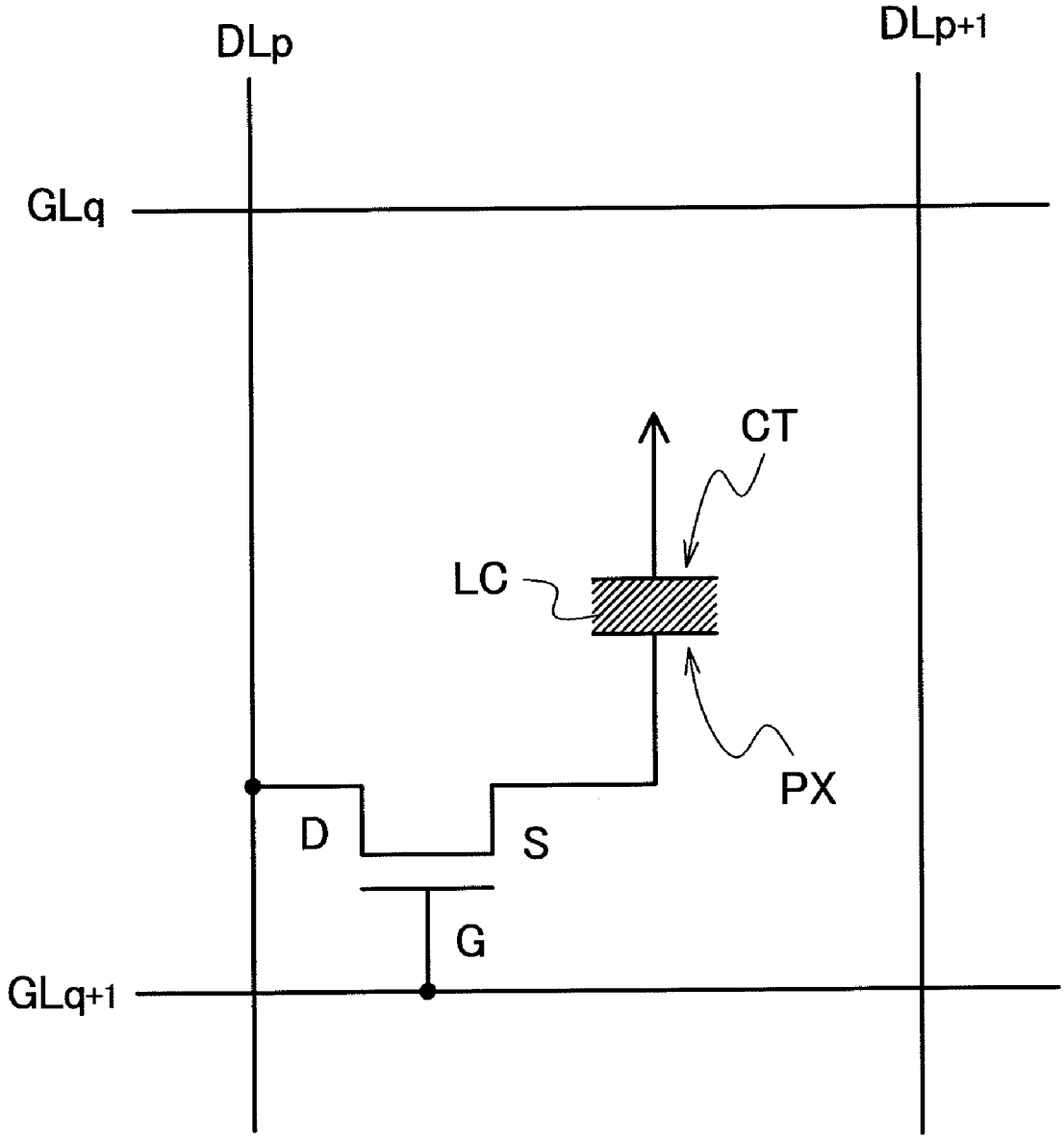
FIG. 3B is a schematic circuit diagram showing one example of the schematic constitution of 1 pixel of a display panel shown in FIG. 3A.
Figure 3C:
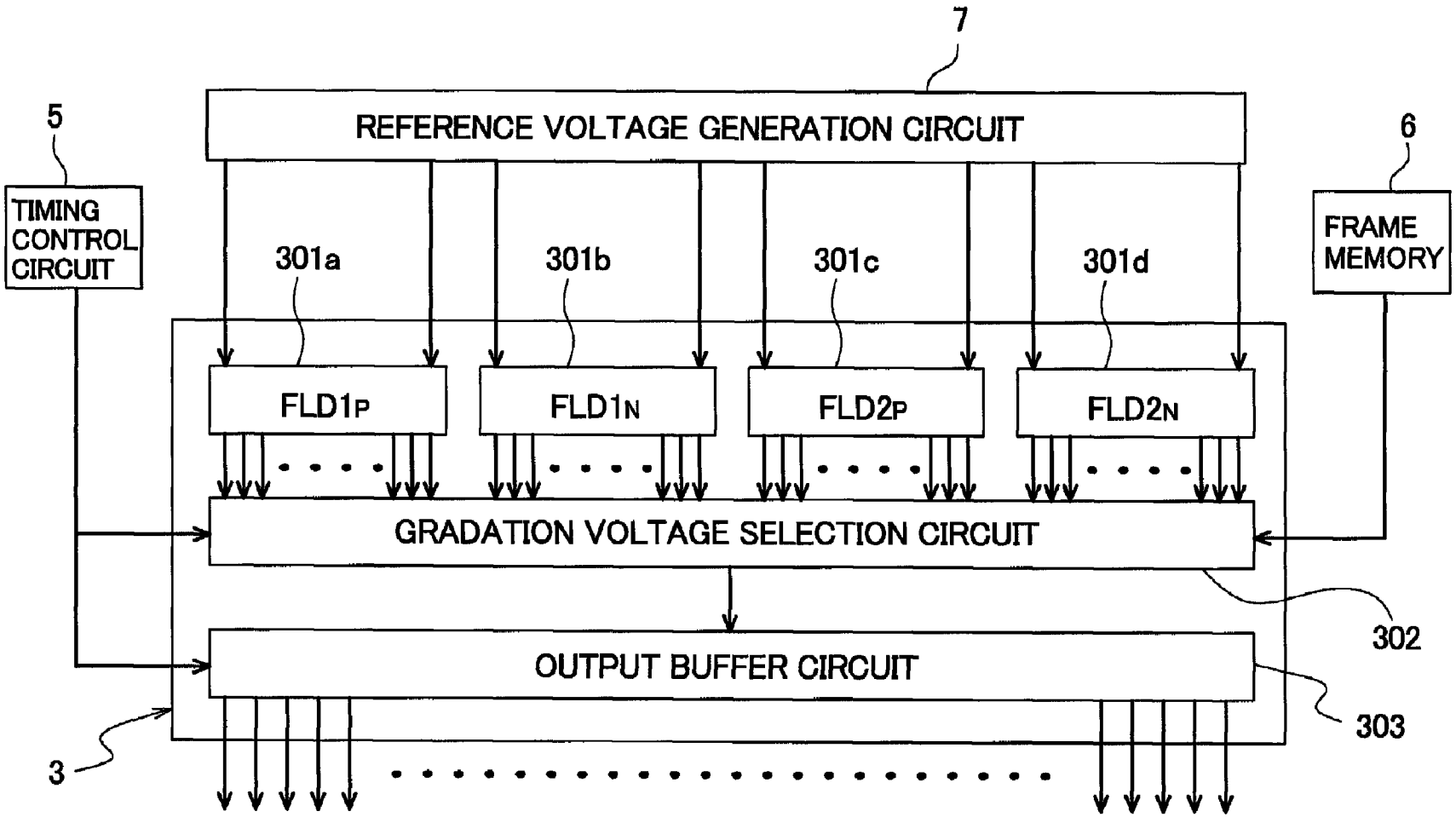
FIG. 3C is a schematic block diagram showing one example of the schematic constitution of a data driver shown in FIG. 3A.
Figure 3D:
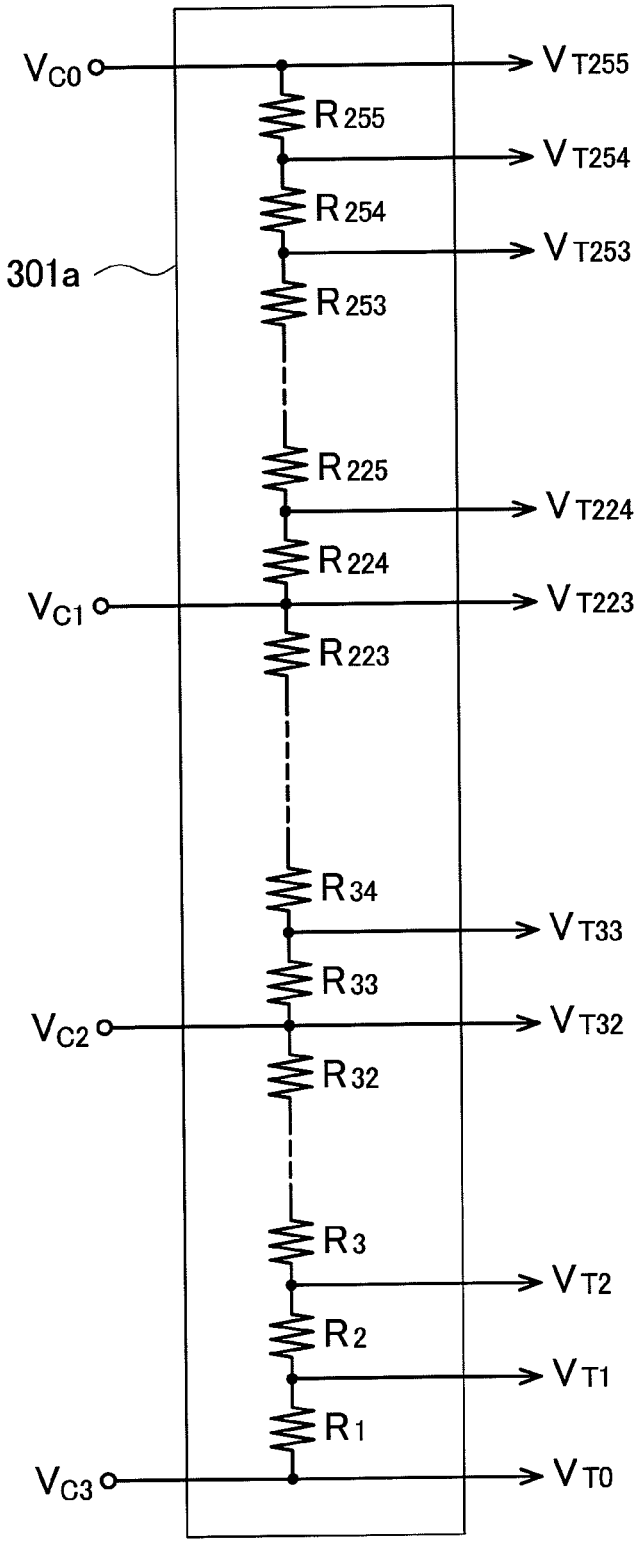
FIG. 3D is a schematic circuit diagram showing one example of the schematic constitution of a resistance voltage dividing circuit shown in FIG. 3C.

FIG. 3A is a schematic block diagram showing one example of the schematic constitution of the display device according to the present invention. FIG. 3B is a schematic circuit diagram showing one example of the schematic constitution of 1 pixel of a display panel shown in FIG. 3A. FIG. 3C is a schematic block diagram showing one example of the schematic constitution of a data driver shown in FIG. 3A. FIG. 3D is a schematic circuit diagram showing one example of the schematic constitution of a resistance voltage dividing circuit shown in FIG. 3C.

The display device according to the present invention is a display device which displays display data inputted from an external system by converting the display data based on the principle explained in conjunction with FIG. 1 and FIG. 2. The constitution of a principle part of the display device is constituted as shown in FIG. 3A to FIG. 3D, for example.

To describe a liquid crystal display device as one example of the display device according to the present invention, for example, as shown in FIG. 3A, in a liquid crystal display panel 2 which offers the display data inputted from the external system to a viewer by displaying the display data, a plurality of video signal lines DL which extends in the longitudinal direction in an elongated manner and a plurality of scanning signal lines GL which extends in the lateral direction in an elongated manner are arranged. Further, one pixel of the liquid crystal display panel 2 has the constitution shown in FIG. 3B, for example, wherein a region surrounded by two neighboring video signal lines $DL_p$, $DL_{p+1}$ and two neighboring scanning signal lines $GL_q$, $GL_{q+1}$ corresponds to one pixel region. Here, in each pixel region, for example, a TFT which serves as a switching element (active element) is formed. Here, the TFT has a gate (G) thereof connected to the scanning signal lines $GL_{q+1}$, a drain (D) thereof connected to the video signal lines $DL_p$ and a source (S) thereof connected to the pixel electrode PX. The pixel electrode PX forms pixel capacitance (also referred to as liquid crystal capacitance) together with a liquid crystal material LC sealed between a pair of substrates and a common electrode (also referred to as a counter electrode) CT. Here, in the liquid crystal display device according to the present invention, shapes and constitutions of the video signal lines DL, the scanning signal lines GL, the TFT, the pixel electrodes PX and the common electrodes CT, kinds of the liquid crystal material LC and the like of the liquid crystal display panel 2 are as same as the corresponding parts of the conventional liquid crystal display panel. Accordingly, their detailed explanation is omitted.

Further, the liquid crystal display device includes a data driver 3 which forms the video signals (also referred to as gradation data) outputted to the respective video signal lines DL of the liquid crystal display panel 2, a scanning driver 4 which forms the scanning signals outputted to the respective scanning signal lines GL of the liquid crystal display panel 2, and a timing control circuit 5 which controls timing at which a gradation voltage is outputted from the data driver 3 and timing at which the scanning signal is outputted from the scanning driver 4.

Further, the liquid crystal display device includes a frame memory 6 which stores and holds display data amounting to at least 1 screen(amounting to 1 frame period), and a reference voltage generation circuit 7 which generates a reference voltage which becomes a basis of gradation data (gradation voltages) generated by the data driver 3.

Further, the data driver 3 includes, for example, as shown in FIG. 3C, four gradation voltage generation circuits 301*a*, 301*b*, 301*c*, 301*d*, a gradation voltage selection circuit 302 which selects one gradation voltage out of gradation voltages generated by four gradation voltage generation circuits, and an output buffer circuit 303 which holds the gradation voltage selected by the gradation voltage selection circuit 302 during 1 line selection period, that is, until display data to be displayed on a plurality of pixels which has the TFT thereof connected to one scanning signal line GL is collected.

The gradation voltage generation circuit 301*a* out of four gradation voltage generation circuits 301*a*, 301*b*, 301*c*, 301*d* is, for example, a circuit which generates a gradation voltage $FLD1_p$ of positive polarity for the display data to be displayed during the first field period FLD1. The gradation voltage generation circuit 301*b* is, for example, a circuit which generates a gradation voltage $FLD1_N$ of negative polarity for the display data to be displayed during the first field period FLD1. The gradation voltage generation circuit 301*c* is, for example, a circuit which generates a gradation voltage $FLD2_P$ of positive polarity for the display data to be displayed during the second field period FLD2. The gradation voltage generation circuit 301*d* is, for example, a circuit which generates a gradation voltage $FLD2_N$ of negative polarity for the display data to be displayed during the second field period FLD2.

Here, the above-mentioned positive polarity and the negative polarity are polarities indicative of the relationship between the potential of the gradation voltage written in the pixel electrodes PX and the potential of the common voltage CT, wherein the positive polarity is polarity which makes the potential of the pixel electrode PX higher than the potential of the common voltage CT, and the negative polarity is polarity which makes the potential of the pixel electrode PX lower than the potential of the common voltage CT.

Further, the gradation voltage generation circuit 301*a* is, for example, a resistance voltage dividing circuit which is formed by connecting a plurality of resistances in series. In case of a liquid crystal display device in which the respective pixels of the liquid crystal display panel correspond to a gradation display of 256 gradations, for example, as shown in FIG. 3D, 255 pieces of resistances $R_1$ to $R_{255}$ are connected in series. Here, for example, reference voltages $V_{C0}$ to $V_{C3}$ are inputted to the gradation voltage generation circuit 301*a* from the reference voltage generation circuit 7, and 256 kinds of gradation voltages of positive polarity ranging from the gradation voltage $V_{T0}$ corresponding to the minimum gradation (0th gradation) to the gradation voltage $V_{T255}$ corresponding to the maximum gradation (255th gradation) are generated by the resistance voltage dividing circuit. The generated gradation voltages of positive polarity are outputted to the gradation voltage selection circuit 302.

Here, resistance values of the resistance $R_1$ to $R_{255}$ which constitutes the resistance voltage dividing circuit of the gradation voltage generation circuit 301*a* are set such that the relative brightness BR when a display is made with the generated gradation voltages assume the distribution such as the brightness curve BD1 shown in FIG. 2, for example.

Further, although the repeated explanation is omitted, the constitutions of the remaining gradation voltage generation circuits 301*b*, 301*c*, 301*d* are also substantially equal to the constitution of the gradation voltage generation circuit 301*a* and, for example, these gradation voltage generation circuits 301*b*, 301*c*, 301*d* generate 256 kinds of the gradation voltages of positive polarity or negative polarity by the resistance voltage dividing circuit which is formed by connecting the 255 pieces of resistances $R_1$ to $R_{255}$ in series, and these gradation voltages are outputted to the gradation voltage selection circuit 302.

The gradation voltage selection circuit 302 selects, for example, the gradation voltage corresponding to one pixel of the display data out of the gradation voltages generated by the respective gradation voltage generation circuits 301*a*, 301*b*, 301*c*, 301*d* based on a clock signal from the timing control circuit 5 and display data held in the frame memory 6, and holds the selected gradation voltage in the output buffer circuit 303 as the gradation data of the pixel. Here, the gradation voltage selection circuit 302 repeats such an operation for all pixels of the display data, and sequentially selects the gradation voltages for all pixels of the display data to be displayed during the above-mentioned 1 line selection period.

The output buffer circuit 303, when the gradation data for all pixels of the display data to be displayed during 1 line selection period is collected, for example, outputs the collected gradation data (gradation voltages) to the respective video signal lines DL based on the clock signal from the timing control circuit 5.

The display device of the present invention can reduce moving image blurring while suppressing lowering of brightness, lowering of contrast and the increase of electricity necessary for light emission by displaying the video data inputted from the external system using the above-mentioned constitution and the display principle

Embodiment

Figure 4:
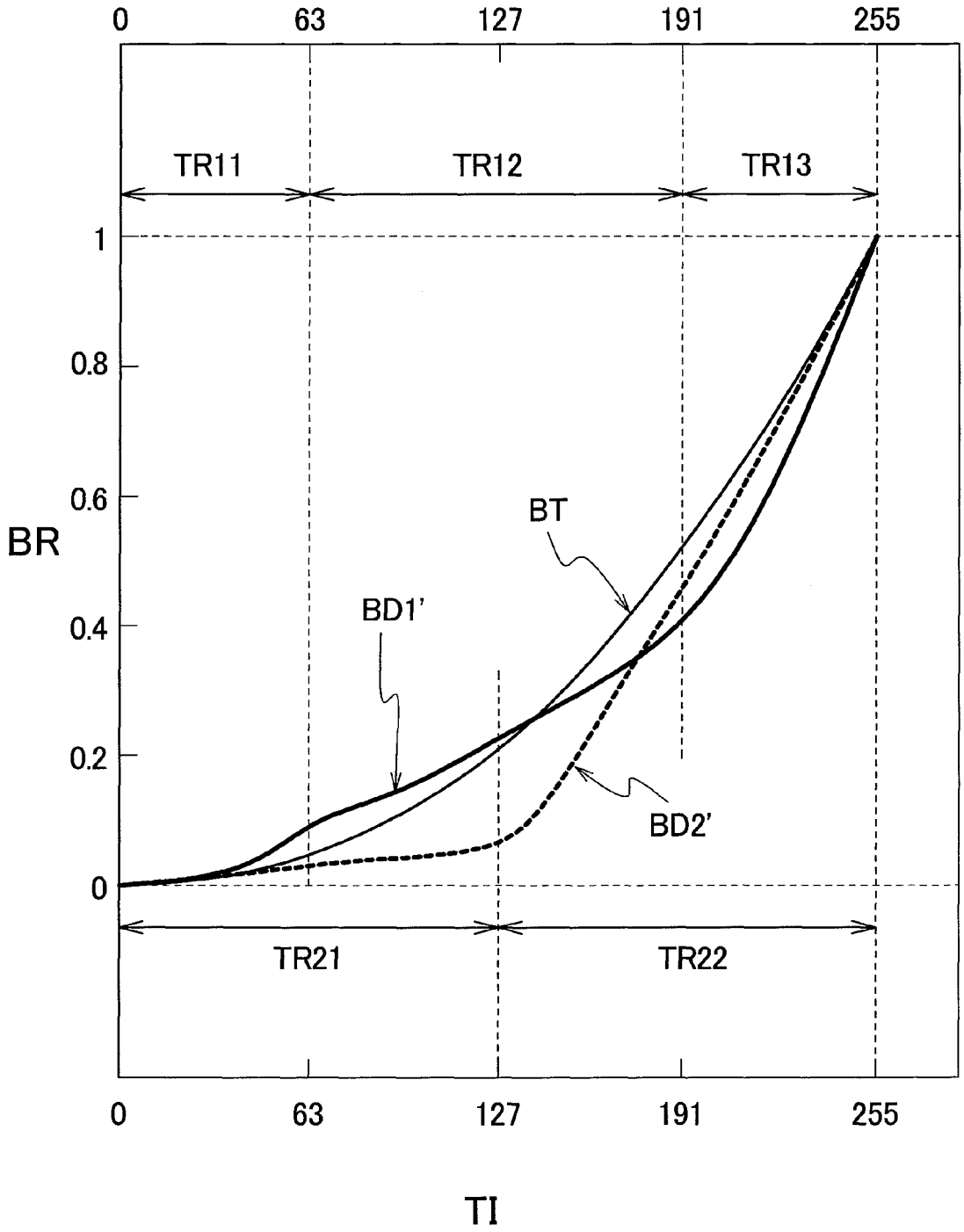
FIG. 4 is a schematic graph showing one example of a display method performed by the display device of one embodiment according to the present invention.

FIG. 4 is a schematic graph showing one example of a display method performed by the display device of one embodiment according to the present invention.

The present invention uses the display device having the constitution shown in FIG. 3A to FIG. 3D and, for example, as shown in FIG. 1 and FIG. 2, the display data amounting to 1 frame period is displayed by dividing 1 frame period into the first field period FLD1 and the second field period FLD2.

Here, by allowing the brightness curve BD1 of the display data to be displayed during the first field period FLD1 to exhibit the distribution shown in FIG. 2, for example, a range of brightness from the brightness of the minimum gradation (0th gradation) to the brightness of the maximum gradation (255th gradation) which is divided into 256 stages in the conventional display device is divided into approximately 192 stages (gradations). Accordingly, for example, the difference of the gradation voltage (relative brightness) between the neighboring gradations in the intermediate gradations approximately ranging from 64th gradation to 192th gradation, for example, becomes larger than the corresponding difference in the gradation voltage (relative brightness) of the conventional display device thus making the gradation expression coarse.

In the same manner, by allowing the brightness curve BD2 of the display data to be displayed during the second field period FLD2 to exhibit the distribution shown in FIG. 2, for example, a range of brightness from the brightness of the minimum gradation (0th gradation) to the brightness of the maximum gradation (255th gradation) which is divided into 256 stages in the conventional display device is divided into approximately 64 stages (gradations). Accordingly, for example, the difference of the gradation voltage (relative brightness) between the neighboring gradations in the gradations equal to or more than 192 gradation becomes larger than the corresponding difference in the gradation voltage (relative brightness) of the conventional display device thus making the gradation expression coarse.

That is, when the brightness curve BD1 for the first field period FLD1 and the brightness curve BD2 for the second field period FLD2 assume the distributions shown in FIG. 2, the difference between the respective brightness curves BD1, BD2 and the brightness curves BT of the conventional display device is large and hence, the gradation expression may become coarse.

Accordingly, this embodiment explains, when the display data amounting to 1 frame period is displayed by dividing 1 frame period into the first field period FLD1 and the second field period FLD2 using the display device having the constitution shown in FIG. 3A to FIG. 3D, one example of the display method capable of reducing moving image blurring and, at the same time, performing the smooth gradation expression.

Inventors of the present invention have found out that the reduction of moving image blurring and the smooth gradation expression can be realized using the display device having the constitution shown in FIG. 3A to FIG. 3D by allowing the brightness curve BD1 for the first field period FLD1 and the brightness curve BD2 for the second field period FLD2 to exhibit the distributions shown in FIG. 4, for example.

Here, in FIG. 4, the gradation TI of the display data is taken on an axis of abscissas, and the relative brightness BR is taken on an axis of ordinates. Further, FIG. 4 shows a case in which the display device can perform the display of 256 gradations from 0th gradation to 255th gradation, and shows the brightnesses of the respective gradations when the brightness at 0 gradation is set to 0th and the brightness at 255th gradation is set to 1.

The brightness curve BD1' (bold solid line) for the first field period FLD1 shown in FIG. 4 is generated by the following method, for example. First of all, the relative brightnesses BR of the respective gradations within a range TR11 from the minimum gradation (0th gradation) to 63th gradation on the brightness curve BD1' are generated by synthesizing the relative brightness (0) of 0th gradation on the brightness curve BD2 for the second field period FLD2 (dark field) shown in FIG. 2 and the relative brightnesses in the respective gradations from 0 gradation to 63th gradation on the brightness curve BD1 for the first field period FLD1 (bright field), for example. By generating the relative brightnesses BR in the above-mentioned manner, within the range TR11 of the brightness curve BD1', a change rate of the brightness becomes larger than a brightness curve BT in the conventional display device and, at the same time, the difference between the change rate of brightness between the display device of this embodiment and the conventional display device is increased along with the increase of the brightness.

Further, the relative brightnesses BR of the respective gradations within a range TR12 from 64th gradation to 191th gradation on the brightness curve BD1' are also generated by synthesizing the relative brightness (0) of 0th gradation on the brightness curve BD2 for the second field period FLD2 (dark field) shown in FIG. 2 and the relative brightnesses of the respective gradations from 64th gradation to 191th gradation on the brightness curve BD1 for the first field period FLD1 (bright field), for example. By generating the relative brightnesses BR in the above-mentioned manner, within the range TR12 of the brightness curve BD1', a change rate of the brightness becomes smaller than a brightness curve BT in the conventional display device and, at the same time, the relative brightness of the brightness curve BD1' becomes smaller than the relative brightness BR of the brightness curve BT from a certain gradation which defines a boundary.

Further, the relative brightnesses BR of the respective gradations within a range TR13 from 192th gradation to 255th gradation on the brightness curve BD1' are also generated by synthesizing the relative brightness (0) of 0th gradation on the brightness curve BD2 for the second field period FLD2 (dark field) shown in FIG. 2 and the relative brightnesses of the respective gradations from 192th gradation to 255th gradation on the brightness curve BD1 for the first field period FLD1 (bright field), for example. By generating the relative brightnesses BR in the above-mentioned manner, within the range TR13 of the brightness curve BD1', a change rate of the brightness becomes larger than a brightness curve BT in the conventional display device and, at the same time, the relative brightnesses of both brightness curves BD1' and the brightness curve BT at the maximum gradation (255th gradation) become 1.

On the other hand, the brightness curve BD2' for the second field period FLD2 shown in FIG. 4 is generated by the following method, for example. First of all, the relative brightnesses BR of the respective gradations within a range TR21 from the minimum gradation (0th gradation) to 127th gradation on the brightness curve BD2' are gradually increased such that, for example, the relative brightness of 0th gradation is set to 0 and the relative brightness of the maximum gradation (127th gradation) within a range TR21 is set to approximately 0.05.

Further, the relative brightnesses BR of the respective gradation within a range TR22 from 128th gradation to 255th gradation on the brightness curve BD2' are generated by synthesizing the relative brightness (1) of 255th gradation of the brightness curve BD1 for the first field period FLD1 (bright field) shown in FIG. 2 and the relative brightnesses of the respective gradations from 128th gradation to 255th gradation on the brightness curve BD2 for the second field period FLD2 (dark field), for example.

By setting the relative brightnesses BR in this manner, both of the distributions (shapes) of the brightness curve BD1' for the first field period FLD1 and the brightness curve BD2' for the second field period FLD2 approximate the distribution (shape) of the conventional brightness curve BT for the display data to be inputted from the external system compared to the brightness curves BD1, BD2 shown in FIG. 2. Accordingly, it is possible to realize the smooth gradation expression compared to the example shown in FIG. 2.

Here, in the example shown in FIG. 4, there exists a region on a high gradation side in which the dynamic brightnesses of both the brightness curve BD1' for the first field period FLD1 and the brightness curves BD2' for the second field period FLD2 are lower than the display brightness on the brightness curve BT of the display data inputted from the external system. However, so long as an average value of the dynamic brightness during the first field period FLD1 and the dynamic brightness during the second field period FLD2 substantially agrees with the display brightness on the brightness curve BT of the display data inputted from the external system, it is possible to reduce moving image blurring.

Still further, in the example shown in FIG. 4, there exists a region on the high gradation side in which the dynamic brightness on the brightness curve BD1' for the first field period FLD1 is lower than the dynamic brightness on the brightness curve BD2' for the second field period FLD2. However, so long as an average value of the dynamic brightness during the first field period FLD1 and the dynamic brightness during the second field period FLD2 substantially agrees with the display brightness on the brightness curve BT of the display data inputted from the external system, it is possible to reduce moving image blurring.

Figure 5:
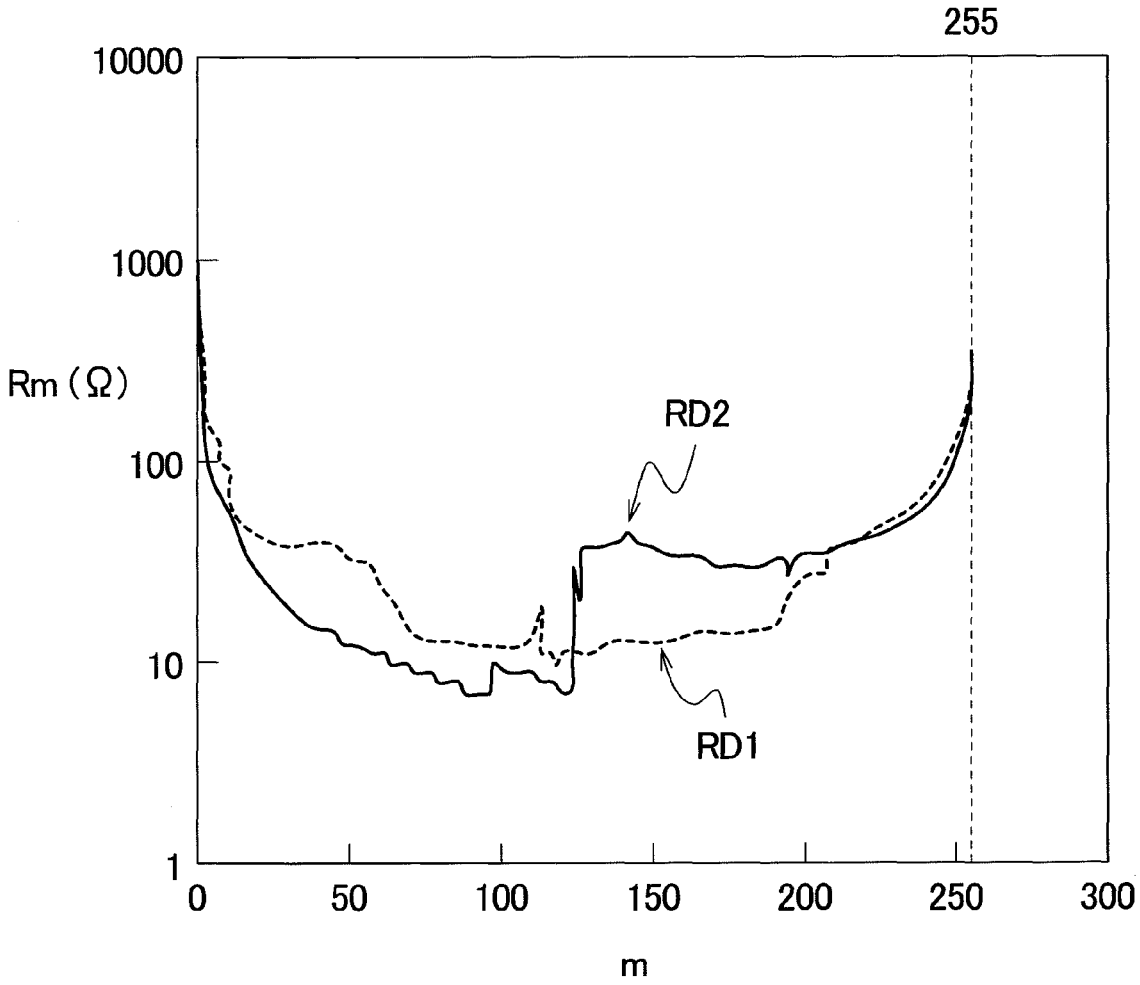
FIG. 5 is a schematic graph for explaining characteristics of a gradation voltage generation circuit for realizing the display method of the embodiment.

FIG. 5 is a schematic graph for explaining characteristics of the gradation voltage generation circuit for realizing the display method of this embodiment.

In the display device having the constitution shown in FIG. 3A to FIG. 3D, for example, in generating the dynamic brightness during the first field period FLD1 and the dynamic brightness during the second field period FLD2 in accordance with the brightness curves BD1', BD2' shown in FIG. 4, the resistance values in the respective resistance voltage dividing circuits of the gradation voltage generation circuits 301*a*, 301*b*, 301*c*, 301*d* may be set as shown in FIG. 5, for example. Here, in FIG. 5, the number of the gradation m is taken on an axis of abscissas and the value of the resistances $R_m$ of the respective resistance voltage dividing circuits are taken on an axis of ordinates. Further, FIG. 5 exemplifies the case in which the respective pixels correspond to the display of 256 gradations, and such a display of 256 gradations corresponds to the resistances $R_1$ to $R_{225}$ of the resistance voltage dividing circuit shown in FIG. 3D.

Out of four gradation voltage generation circuits 301*a*, 301*b*, 301*c*, 301*d*, the gradation voltage generation circuit 301*a* which generates the gradation voltage $FLD1_P$ of positive polarity for the display data to be displayed during the first field period FLD1 is, for example, as shown in FIG. 3D, configured such that 254 pieces of resistances $R_1$ to $R_{255}$ are connected in series. Here, the resistance values of the respective resistances $R_1$ to $R_{255}$ are set to values which assume the distribution RD1 indicated by the dotted line in FIG. 5, for example. Further, resistance values of the respective resistances $R_1$ to $R_{255}$ of the gradation voltage generation circuit 301*b* which generates the gradation voltage $FLD1_N$ of negative polarity for the display data to be displayed during the first field period FLD1 are also set to values which assume the distribution RD1 indicated by a dotted line in FIG. 5. Here, resistance values of the respective resistances $R_{64}$ to $R_{191}$ which change magnitudes of the gradation voltages for the intermediate gradations from 64th gradation to 191th gradation are set to an approximately fixed value.

By setting the resistance values of the respective resistances in the above-mentioned manner, the brightnesses of the display data to be displayed with the respective gradation voltages generated by the gradation voltage generation circuits 301*a*, 301*b* take the brightness curve BD1' shown in FIG. 4.

On the other hand, the resistance values of the respective resistances $R_1$ to $R_{255}$ of the gradation voltage generation circuit 301*c* for generating the gradation voltage $FLD2_P$ of positive polarity for the display data to be displayed during the second field period FLD2 and the resistance values of the respective resistances $R_1$ to $R_{255}$ of the gradation voltage generation circuit 301*d* for generating the gradation voltage $FLD2_N$ for the display data to be displayed during the second field period FLD2 are set to values which assume the distribution RD2 indicated by a solid line in FIG. 5, for example. Here, for example, the resistance values are sharply changed in the vicinity of the 128th gradation, wherein the gradation voltage generation circuits 301*c*, 301*d* take the resistance values lower than the corresponding resistance values of the gradation voltage generation circuits 301*a*, 301*b* at the gradations lower than 128 gradation, and the gradation voltage generation circuits 301*c*, 301*d* take the resistance values higher than the corresponding resistance values of the gradation voltage generation circuits 301*a*, 301*b* at the gradations higher than 128th gradation.

By setting the resistance values of the respective resistances in the above-mentioned manner, the brightnesses of the display data to be displayed with the respective gradation voltages generated by the gradation voltage generation circuits 301*c*, 301*d* take the brightness curve BD2' shown in FIG. 4.

As has been explained hereto fore, according to the display device of the present invention, it is possible to reduce moving image blurring while suppressing lowering of brightness, lowering of contrast and the increase of electricity necessary for light emission.

Further, the present invention can realize the smooth gradation expression within a range which does not bring about lowering of moving image display property such as moving image blurring.

Although the present invention has been specifically explained in conjunction with the embodiment heretofore, it is needless to say that the present invention is not limited to the above-mentioned embodiment and various modifications are conceivable without departing from the gist of the present invention.

For example, in the above-mentioned embodiment, the liquid crystal display device has been exemplified. However, the present invention is not limited to the liquid crystal display device, and is applicable to any hold-response-type display device which displays a video or an image using the substantially equal principle. As the display device to which the present invention is applicable besides the liquid crystal display device, for example, an organic EL display, an LCOS (Liquid Crystal On Silicon) display or the like is named.

What is claimed is:

1. A display device comprising:

a display panel having a plurality of pixels;

a first driver generating gradation voltages corresponding to gradation of the respective pixels based on display data inputted from an external system and outputting the gradation voltages to the respective pixels of the display panel, the first driver including a first gradation voltage generation circuit which generates first gradation voltages and a second gradation voltage generation circuits which generates second gradation voltages based on gradations of display data for 1 screen displayed during 1 frame period;

a second driver for selecting pixels to be supplied with the gradation voltages, the second driver scanning the respective pixels twice within the 1 frame period, the display device being configured such that the respective pixels of the display panel perform displays of gradations based on the first gradation voltages and displays of gradations based on the second gradation voltages during the 1 frame period to display the gradations of the respective pixels in the display data inputted from the external system, wherein the first gradation voltage generation circuit and the second gradation voltage generation circuit respectively include a resistance voltage dividing circuit which is constituted by connecting a plurality of resistances in series, wherein the resistance voltage dividing circuit of the first gradation voltage generation circuit sets a plurality of resistance values which change magnitudes of the plurality of gradation voltages at intermediate gradations to an approximately fixed value, and wherein the resistance voltage dividing circuit of the second gradation voltage generation circuit, in gradation intermediate regions where the plurality of resistance values of the resistance voltage dividing circuit of the first gradation voltage generation circuit is set to an approximately fixed value, changes the resistance values from resistance values lower than the resistance values of the resistance voltage dividing circuit of the first gradation voltage generation circuit to resistance values higher than the resistance values of the resistance voltage dividing circuit of the first gradation voltage generation circuit.

2. A display device according to claim 1, wherein the first gradation voltage generation circuit and the second gradation voltage generation circuit respectively include a resistance voltage dividing circuit which generates gradation voltages of positive polarity and a resistance voltage dividing circuit which generates gradation voltages of negative polarity.

* * * * *